US006499242B2

(12) United States Patent
Rudick et al.

(10) Patent No.: US 6,499,242 B2
(45) Date of Patent: Dec. 31, 2002

(54) METHODS AND ASSEMBLIES FOR CHANGING VENDING MACHINE SIGN FACE GRAPHICS

(75) Inventors: Arthur G. Rudick, Atlanta; William S. Credle, Jr., Stone Mountain, both of GA (US)

(73) Assignee: The Coca-Cola Company, Atlanta, GA (US)

( * ) Notice: Subject to any disclaimer, the term of this patent is extended or adjusted under 35 U.S.C. 154(b) by 46 days.

(21) Appl. No.: 09/771,973

(22) Filed: Jan. 30, 2001

(65) Prior Publication Data

US 2001/0004811 A1 Jun. 28, 2001

Related U.S. Application Data

(62) Division of application No. 09/219,358, filed on Dec. 23, 1998, now Pat. No. 6,195,924.

(51) Int. Cl.[7] ..... G09F 11/18

(52) U.S. Cl. ..... 40/515; 40/514; 312/204

(58) Field of Search ..... 40/515, 514, 611, 40/594; 312/36, 42, 234.1, 234.2, 234.3, 204

(56) References Cited

U.S. PATENT DOCUMENTS

| | | | | | |
|---|---|---|---|---|---|
| 516,884 | A | | 3/1894 | Attaway | 40/611 |
| 2,258,525 | A | | 10/1941 | Vigurs | 40/514 |
| 3,609,897 | A | | 10/1971 | Bartlett | 40/514 |
| 3,938,269 | A | * | 2/1976 | Catteau | 40/515 |
| 4,345,392 | A | | 8/1982 | Cornell | 40/514 X |
| 5,255,968 | A | | 10/1993 | Craven | 40/611 X |
| 5,471,794 | A | | 12/1995 | Nishioka | 40/611 X |
| 5,488,791 | A | | 2/1996 | Boni | 40/518 X |
| 5,509,225 | A | | 4/1996 | Minh et al. | 40/611 |
| 5,598,655 | A | | 2/1997 | McGarrah | 40/611 |
| 5,809,677 | A | | 9/1998 | Wamser et al. | 40/518 X |
| 5,953,840 | A | | 9/1999 | Simson | 40/518 X |

FOREIGN PATENT DOCUMENTS

| | | |
|---|---|---|
| JP | 3-67384 | 3/1991 |
| JP | 7-219461 | 8/1995 |
| JP | 9-16840 | 1/1997 |
| JP | 10-333572 | 12/1998 |

* cited by examiner

*Primary Examiner*—William L. Miller
(74) *Attorney, Agent, or Firm*—Finnegan, Henderson, Farabow, Garrett & Dunner LLP

(57) ABSTRACT

Methods and assemblies are described for displaying interchangeable graphics sheets on a display face of a merchandise cabinet such as a vending machine. The interchangeable sheets are stored on spool assemblies disposed within the cabinet and may be either manually or automatically manipulated in order to selectively register different graphics sheets within the display face of the vending machine. In a first embodiment, the graphics sheets have adhesive areas thereon in order to attach an old graphic sheet to a new graphic sheet to unwind the new graphic sheet from the spool assembly and position it into the display field on the face of the vending machine. The old graphics sheet functions as a leader for the new graphics sheet. In a second embodiment, the graphics sheets are provided with tear-off flexible leaders which are utilized to unwind the sheets from the storage spool assemblies and to position the graphics sheet into registry with the display fields on the face of the vending machine. In a third embodiment, an elongated graphics sheet having groups of graphic regions spaced thereon is wound onto a pair of spaced spool assemblies on opposite sides of the display field. A drive mechanism for rotating the spools is provided to selectively position selected ones of the groups of graphics into registry with the display field. A controller for selectively activating the drive mechanism to position the selected groups of graphics in the display field is provided and may include a timer for automatically activating the drive mechanism to change the groups of graphics or a suitable remote control and detector combination in order to selectively change the graphics by remote command signals.

20 Claims, 4 Drawing Sheets

METHODS AND ASSEMBLIES FOR CHANGING VENDING MACHINE SIGN FACE GRAPHICS

This is a divisional of application Ser. No. 09/219,358, filed Dec. 23, 1998, now U.S. Pat. No. 6,195,924, issued Mar. 6, 2001, which is incorporated herein by reference.

BACKGROUND OF THE INVENTION

The present invention relates to a method and apparatus for displaying interchangeable graphic sheets on the display face of a merchandise cabinet, such as a coin-operated vending machine. More specifically, the present invention relates to improved methods and systems for storing interchangeable graphic sheets within the vending machine cabinet, and methods and assemblies for quickly and efficiently changing the graphic sheets in order to achieve high quality graphic displays.

Traditionally, graphic sheets on the front doors of vending machines were more or less permanently installed. If it was desired to change the graphics on these doors, it often took between fifteen minutes to two hours to change the signs in order to display new graphics.

Recently there has been a trend in the vending machine industry to provide interchangeable graphic sheets on portions of the vending machine sign panel, such as in a window provided in the panel surrounded by more permanent associated graphics. Various means for quickly changing such graphic sheets have been contemplated. An example of one such system is described in U.S. Pat. No. 5,509,225 to Minh et al., assigned to the same assignee as the present invention.

In Minh, the interchangeable graphic sheets may be rolled up and stored in the machine in any suitable space therein. However, no specific storage device is provided for the rolled sheets, so the sheets may become crumpled or damaged making it difficult to neatly and efficiently change the graphic sheets on the windows of the associated sign panels.

Therefore, there is a need in the art for methods and systems for neatly and efficiently storing rolled-up graphic sheets in or near vending machines which lend themselves to quick interchangeability of the sheets either manually or automatically.

SUMMARY OF THE INVENTION

Accordingly, it is a primary object of the present invention to provide methods and assemblies for neatly storing vending machines graphic sheets for achieving interchangeable displays on the sign faces of the vending machines.

It is another object of the present invention to provide improved methods and assemblies for manually handling the graphic sheets for effecting the interchange thereof on the sign panels.

It is a further object of the present invention to provide methods and assemblies for automatically storing and changing flexible graphic sheets on the sign panels of vending machines.

The objects of the present invention are fulfilled by providing a method of displaying interchangeable graphic sheets on a display face of a merchandise cabinet comprising the steps of:

providing a storage spool assembly in or near the cabinet with interchangeable graphic sheets thereon;

unwinding a selected one of the graphic sheets from the spool assembly;

placing the selected graphic sheet in a display field on the display face for a desired period of time;

removing the selected graphic sheets from a display field at the end of the desired period of time;

unwinding a different graphic sheet from the spool assembly;

placing the different graphic sheet in the display field; and repeating the above steps as often as desired to effect a display of interchangeable graphics.

In a first embodiment of the present invention, each graphic sheet is wound on a separate spool and has adhesive material on either of the leading or trailing end of the sheet. In order to effect the interchange of the sheets an end of the old graphic sheet just removed from the display field is secured to the leading end of a new graphic sheet on another spool to form a leader for the new graphic sheet by pressing the leading and trailing ends together to form an adhesive coupling. The new graphic sheet is then unwound by manually pulling on the old graphic sheet. The old graphic sheet is then detached from the new graphic sheet and the old graphic sheet is wound onto a spool for future use.

In a second embodiment, each graphic sheet wound on the spool has a flexible elongated leader on a leading edge thereof for unwinding the graphic sheet from the spool. The leader is readily severable from the graphic sheet so that it can be removed once the sheet is secured in the display field of the sign face.

In a third embodiment of the present invention, a continuous graphic sheet is provided with separate graphics regions thereon. The sheet is wound on a spool and selected regions of the graphic sheet are unwound from the spool into registry with the display field on the sign panel for selected display periods.

In the third embodiment, the spool assembly includes two spaced spools disposed at opposite ends of the display field, and the selective placing of graphics regions is implemented by winding the graphic sheet from one spool to the other. A drive mechanism is provided for rotating the first and second spools to selectively position the selected ones of the groups of graphics into registry with a display field. A controller is provided for selectively activating the drive mechanism. In one embodiment, the controller includes a timer for automatically activating the drive mechanism to change the groups of graphics displayed at selectable intervals. In another embodiment, the controller includes a detector responsive to remote command signals for activating the drive mechanism.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF PREFERRED EMBODIMENTS

Figure 1:
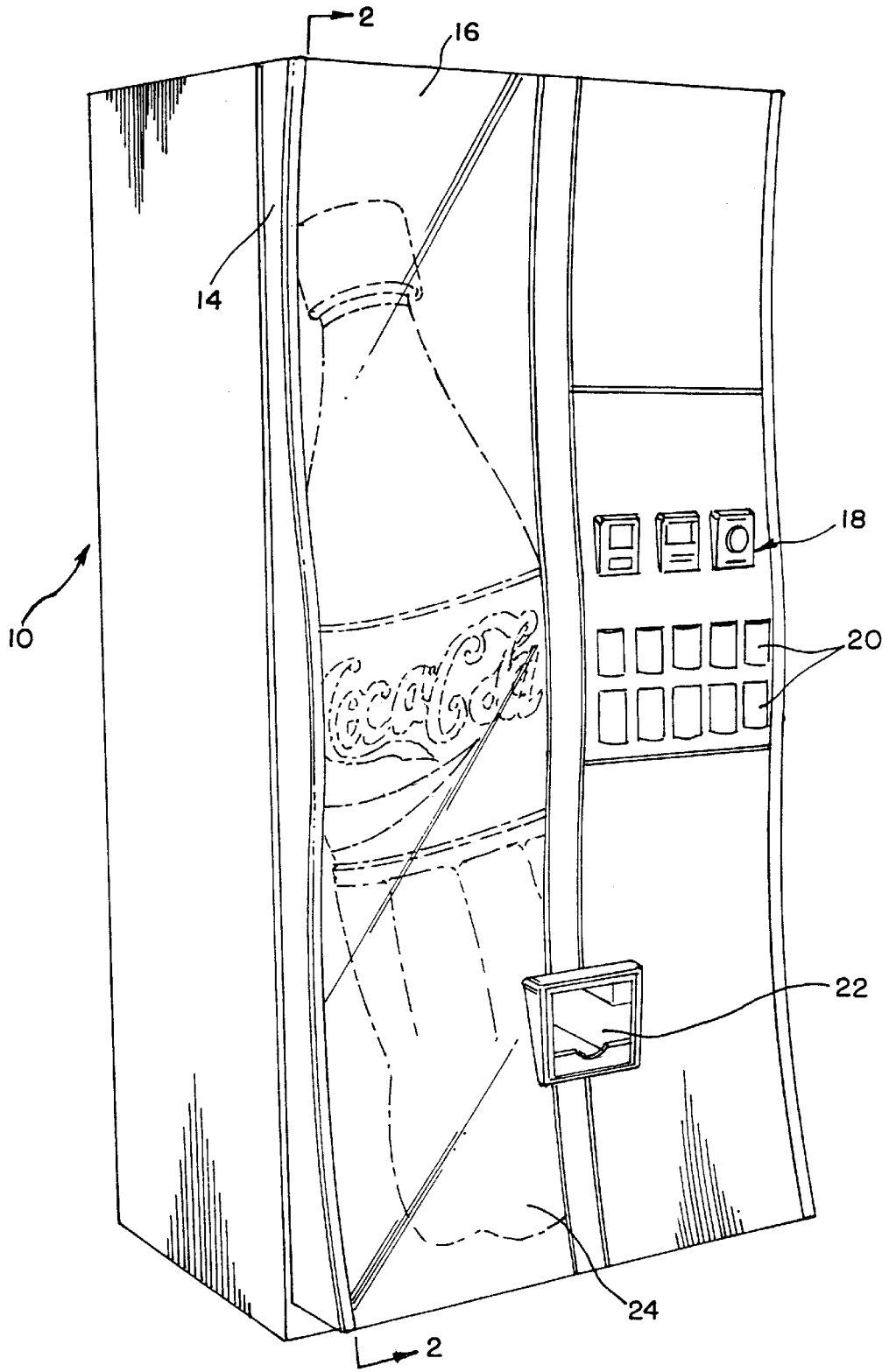
FIG. 1 is a perspective view of a vending machine illustrating a sign panel on the front face thereof defining a display field in which the interchangeable graphic sheets may be substituted as desired to achieve different displays.

Referring to FIG. 1, there is illustrated a vending machine generally indicated 10 having a hinged front door 14 with a sign panel 16 thereon in which interchangeable graphic displays or sheets are mounted in accordance with the methods and assemblies of the present invention. One such graphic sheet 24 is depicted which is the proprietary bottle of The Coca-Cola Company, and a registered trademark. The vending machine 10 also includes a coin-operated mechanism 18, a plurality of selection buttons 20 and a discharge port 22 for the vendable products. The vending machine 10 illustrated in FIG. 1 is merely one example of a type of vending machine suitable for use with the methods and assemblies of the present invention.

Figure 2:
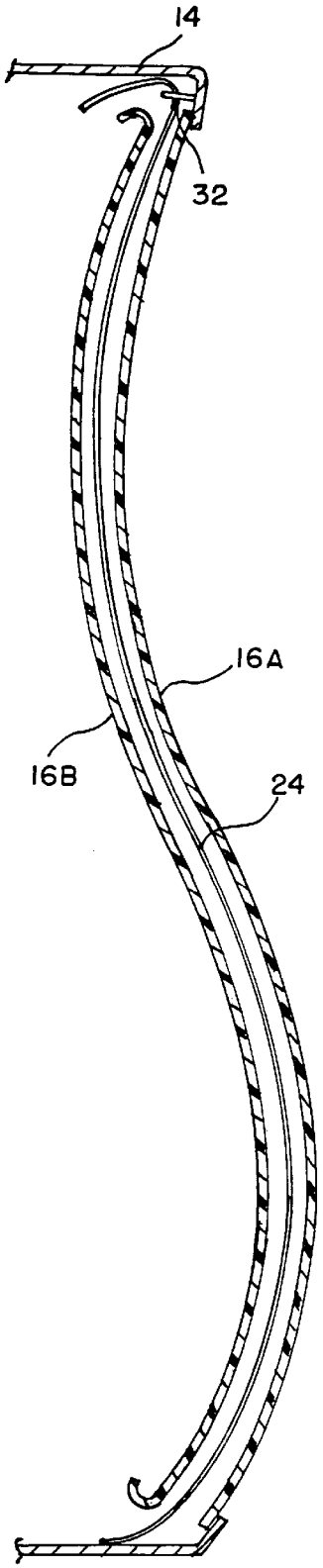
FIG. 2 is a sectional view along line 2—2 of FIG. 1 illustrating the spaced inner and outer sign faces between which the graphic sheets are interchangeably mountable.
Figure 3:
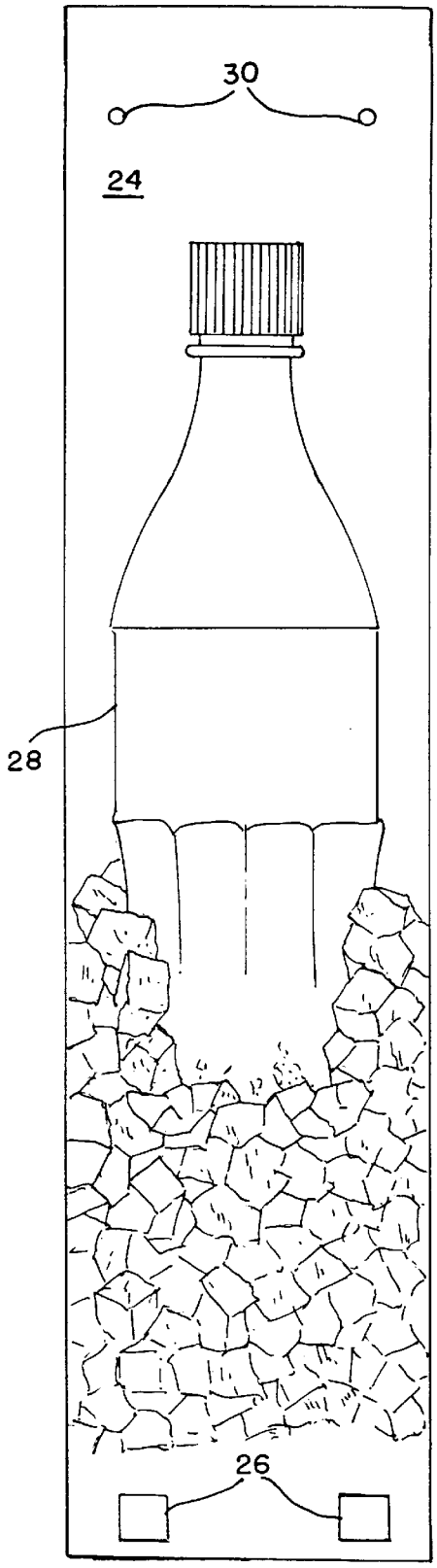
FIG. 3 is a first embodiment of an interchangeable graphic sheet for use in a first method of the present invention.

Referring to FIGS. 2 and 3, there is illustrated a first embodiment of the present invention which illustrates two parallel sign faces 16A and 16B of the door 14 which are separated by a gap of approximately ⅛-inch. The outer sign face 16A should be thick enough to provide vandal resistance and is attached to the door frame of door 14. The inner sign face 16B is attached to the outer sign face via ⅛-inch thick spacer strips located between both vertical edges of the sign faces. These spacer strips are omitted from the drawing for clarity. The graphic sheet 24 is located in the space between the two sign faces 16A, 16B. The ⅛-inch thick spacer strips define the vertical edges of the space and the display field for the graphic sheets and thus locate the graphics sheet horizontally. Registration holes 30 are provided in the top of the graphics sheet to hook the sheet over registration pegs 32 on the door frame. The upper attachment area including the registration pegs 32 is disposed slightly above the two sign face regions within the door 14. A lower attachment area extends slightly below the bottom of the two sign faces 16A, 16B. The graphic sheet 24 is formed from a flexible transparent material such as Mylar and has the graphics 28 printed thereon. Additional graphics sheets 24 are storable on spools such as cardboard cores (not shown) and which are preferably stored somewhere within a suitable space in the vending machine.

The bottom of a graphics sheet 24 is provided with adhesive material which is preferably two pieces of doubled-faced tape 26.

In order to change the graphics sheet 24, a service technician would do the following:

1. Open the vending machine's door 14 to access the interior of the graphics area.

2. Unwind the new graphics sheet 24 from its storage core.

3. Remove the cover papers from the pieces of double-face tape 26 on the lower attachment area.

4. Fasten the lower attachment area of the new graphics sheet 24 to the upper attachment area of the old graphics sheet via the double-faced tape 26.

5. Unhook the old graphics sheet from the registration pegs 32.

6. Pull on the lower attachment area of the old graphics sheet using the old graphic sheet as a leader to pull the new graphic sheet into the space between the sign faces 16A, 16B.

7. When the new graphic sheet is in place, hook it's registration holes 30 over the registration pegs 32.

8. Detach the old graphics sheet and wind it around the storage core for re-use at a later date.

Accordingly, a neat and efficient method and assembly are provided for storing and interchangeably displaying flexible graphic sheets on the sign face of a vending machine.

Figure 4:
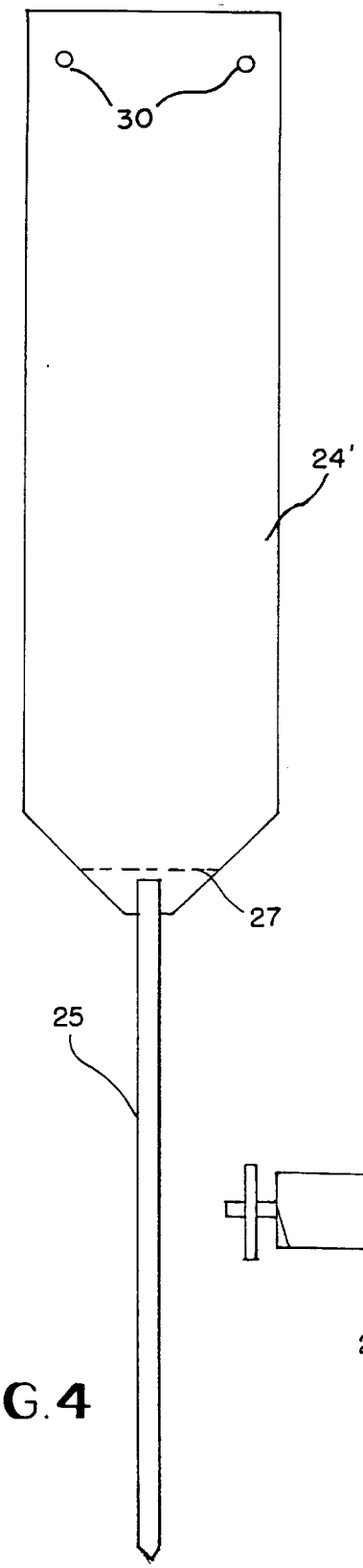
FIG. 4 illustrates a graphic sheet for a second embodiment of the present invention provided with an integrally attached leader.
Figure 5:
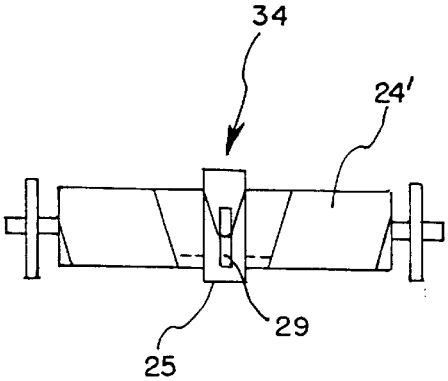
FIG. 5 is a front elevational view of a storage spool assembly for storing the graphic sheet of FIG. 4 thereon.
Figure 6:
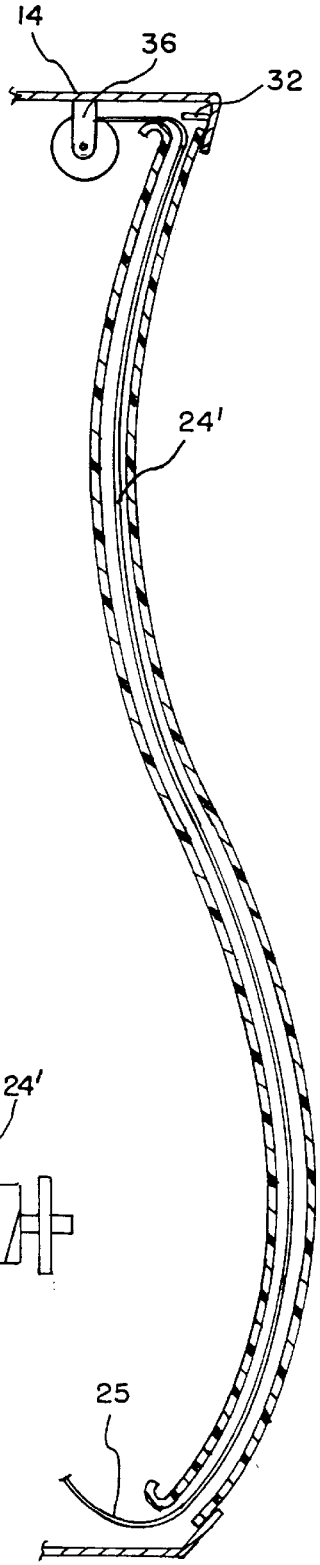
FIG. 6 is a cross-sectional view taken along line 2—2 of FIG. 1 illustrating the location of the spool assembly of FIG. 5 and the position of the leader and graphics sheet of the second embodiment of FIG. 4 between the front and rear sign faces.

The second embodiment of the present invention is illustrated in FIGS. 4– 6. Referring to FIG. 4, the graphics sheet 24' comes with a semi-ridged leader strip 25 attached to the bottom end thereof. The leader strip 25 is flexible enough so that it can be wound around a flanged spool 34 illustrated in detail in FIG. 5. The leader 25 is ridged enough to allow it to be fed all of the way through the space between the sign faces 16A, 16B by pushing it from the top as illustrated in FIG. 6.

The graphics sheet 24' and leader 25 are wound around the storage spool 34 as illustrated in FIG. 5. The flanged storage spool 34 is mounted in the top of the door 14 in spaced brackets 36. The storage spool 34 easily snaps into the brackets 36 using the same method that you would use to snap a roll of paper towers into a kitchen paper towel holder. The storage spool 34 guides the graphic sheets straight into the space between the sign faces 16A and 16B, thus preventing wrinkling or binding. The leader 25 is windable on the spool along with the graphics sheet 24' and may be secured at it's end by a piece of removable tape 29.

In order to change the graphics sheet 24', a service technician would do the following:

1. Open the vending machine door 14 to access the interior of the graphics area.

2. Remove the old graphics sheet.

3. Snap the new graphics sheet storage spool assembly 34 into the "paper towel holder" type brackets 36.

4. Untape the leader by removing tape 29 and feed the leader 25 into the top of the space between the sign faces 16A, 16B until it emerges out the bottom of the space.

5. Grasp the tip of the leader 25 and use it to pull the graphics sheet into registry with the display field between the respective sign face panels 16A, 16B.

6. Hook the registration holes 30 of the graphics sheet 24' over the registration pegs 32—remove the storage spool.

7. Tear the bottom tip of the graphics sheet 24' off at the perforations 27 to remove the leader strip 25.

The first and second embodiments of the present invention describe manual methods for handling and interchanging the graphics sheets on the sign panel of a vending machine.

Figure 7:
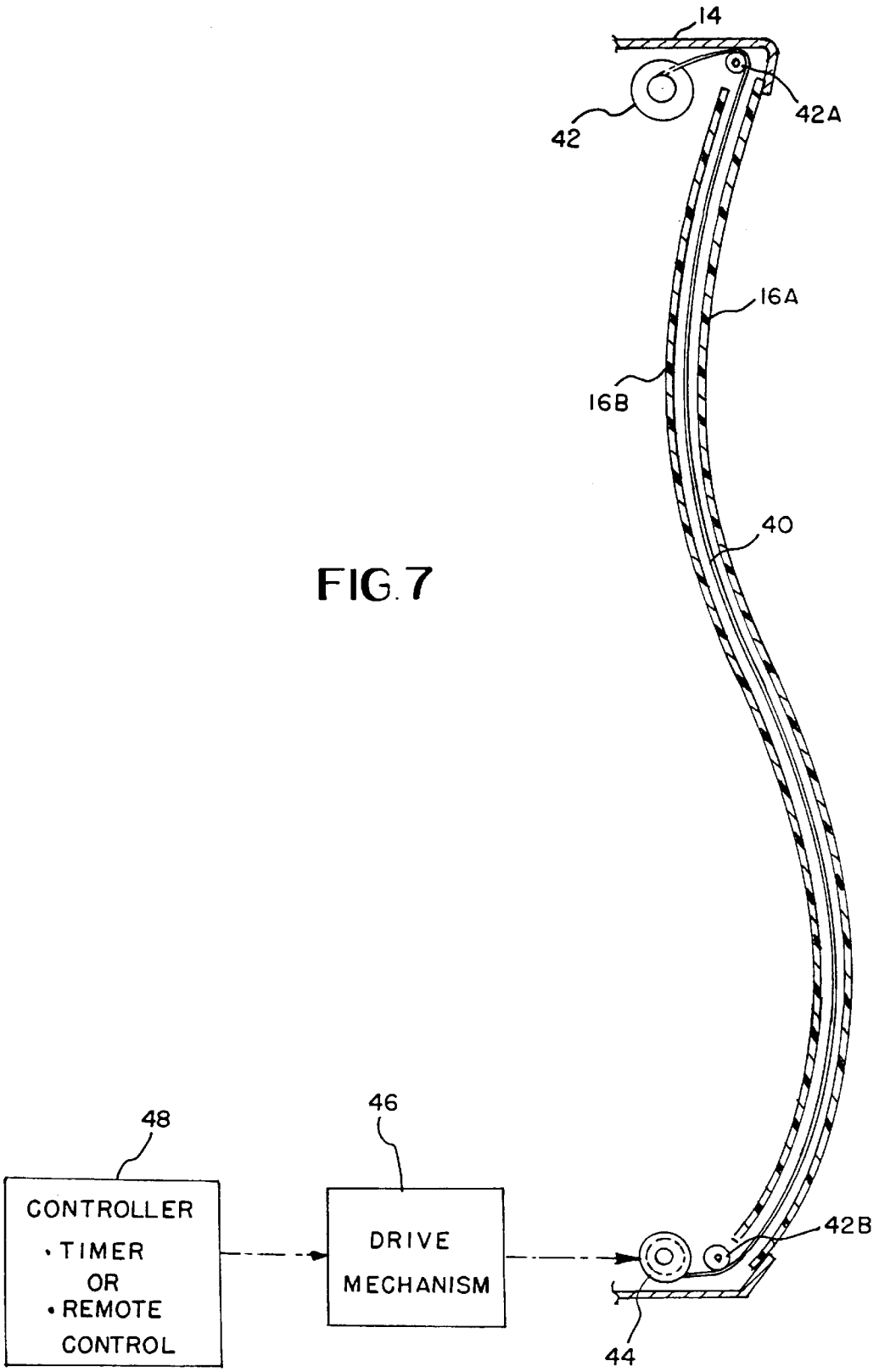
FIG. 7 is a diagrammatic view of a third embodiment of the present invention including an automatically changeable graphic sheet assembly.

In a third embodiment of the present invention, a method and assembly for automatically changing the sign face graphics is described and illustrated in FIG. 7.

As with the other embodiments, the cross-sectional view of the sign panel including spaced faces 16A and 16B is illustrated as being disposed within the vending machine door 14. The interchangeable graphics sheet is illustrated at 40 and comprises a continuous thin flexible sheet with spaced separate sign face graphic regions printed end to end along the sheet. The sheet 40 is wound on two spaced spools 42 and 44 disposed at the top and bottom of the sign face defining a display field therebetween. The sheet 40 feeds over idler rollers 42A and 42B as it moves from one spool to the other. A suitable drive mechanism 46 is provided to drive one or both spools 42 or 44 as desired. A controller 48 is provided to activate the drive mechanism 46. The controller 48 may include a timer or a remote control device for operating the drive mechanism in a manner to be more fully described hereinafter. The long sheet 40 including the plurality of spaced graphics regions is rotated to selectively position the regions into registry in a display field between their respective spools 42 and 46 by operation of the drive mechanism 46. The timer within controller 48 may be designed to initiate command signals to the drive mechanism to selectively position the graphics display regions into the display field for desired periods of time. These periods of time may be predetermined or programmable as desired. The position of the graphics on the sheet 40 with respect to the display field can be registered by any one of several methods. Possible registration methods includes the use of dots of magnetic ink near the sheet's edge picked up by an associated magnetic sensor within the vending machine cabinet, or by the use of holes near the sheet's edge which would be detected by appropriate optical sensors.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A vending machine, comprising:

a vending cabinet configured to vend at least one selected product;

a display field at a face of the vending cabinet;

two spaced panels defining a slot associated with the display field;

a storage spool configured to be mounted to the vending cabinet;

a graphics sheet wound onto the storage spool, including graphics associated with said at least one selected product; and an elongated leader associated with the graphics sheet, the elongated leader being configured to be fed through the slot.

2. The machine of claim 1, wherein the elongated leader is wound onto the storage spool.

3. The machine of claim 2, wherein the elongated leader is configured to be unwound from the storage spool.

4. The machine of claim 1, wherein the elongated leader is configured to facilitate unwinding of the graphics sheet from the storage spool.

5. The machine of claim 1, wherein the elongated leader is configured to facilitate feeding of the graphics sheet into the slot.

6. The machine of claim 1, wherein the elongated leader is removably attached to the graphics sheet.

7. The machine of claim 6, wherein the graphics sheet comprises a perforation, and the elongated leader is configured to be removed by tearing along the perforation.

8. The machine of claim 1, wherein the storage spool is removably mounted to the vending cabinet.

9. The machine of claim 1, wherein the graphics sheet comprises at least one attachment member configured to attach the graphics sheet to the vending cabinet.

10. The machine of claim 9, wherein the graphics sheet is configured to be attached to the vending cabinet after being unwound from the storage spool.

11. The machine of claim 9, wherein the at least one attachment member comprises a hole configured to be placed around a peg disposed on the vending cabinet.

12. A method of displaying graphics on a vending machine, the method comprising:

providing a storage spool having a graphics sheet wound thereon, an elongated leader being associated with the graphics sheet;

inserting the elongated leader into a first end of a slot, the slot being formed by two spaced panels associated with a display field of a vending cabinet, the vending cabinet being configured to vend at least one selected product, the graphics sheet including graphics associated with said at least one selected product;

feeding the elongated leader through the slot and out of a second opposite end of the slot; and pulling a portion of the elongated leader emerging from the second end of the slot until the graphics sheet occupies the display field.

13. The method of claim 12, further comprising detaching the elongated leader from the graphics sheet while the graphics sheet remains in the display field.

14. The method of claim 13, further comprising removing the graphics sheet from the storage spool.

15. The method of claim 14, wherein the graphics sheet is removed from the storage spool before detaching the elongated leader from the graphics sheet.

16. The method of claim 12, wherein said pulling comprises unwinding the graphics sheet from the storage spool.

17. The method of claim 12, further comprising unwinding the elongated leader from the storage spool.

18. The method of claim 12, further comprising removing the graphics sheet from the storage spool.

19. The method of claim 18, further comprising attaching the graphics sheet to the vending cabinet.

20. The method of claim 19, further comprising detaching the elongated leader from the graphics sheet while the graphics sheet remains in the display filed.

* * * * *

UNITED STATES PATENT AND TRADEMARK OFFICE

CERTIFICATE OF CORRECTION

PATENT NO. : 6,499,242 B2
DATED : December 31, 2002
INVENTOR(S) : Rudick et al.

It is certified that error appears in the above-identified patent and that said Letters Patent is hereby corrected as shown below:

Column 6,
Line 56, "filed" should read -- field --.

Signed and Sealed this

Eleventh Day of March, 2003

JAMES E. ROGAN
*Director of the United States Patent and Trademark Office*